United States Patent [19]

Furutsu

[11] Patent Number: 4,461,417

[45] Date of Patent: Jul. 24, 1984

[54] TAG ATTACHER

[75] Inventor: Akira Furutsu, Tokyo, Japan

[73] Assignees: Japan Bano'k Co., Ltd., Tokyo, Japan; Ben Clements & Sons, Inc., South Hackensack, N.J.

[21] Appl. No.: 329,090

[22] Filed: Dec. 9, 1981

[30] Foreign Application Priority Data

Dec. 19, 1980 [JP] Japan ..... 55-178799

[51] Int. Cl.[3] ..... B65C 7/00

[52] U.S. Cl. ..... 227/67

[58] Field of Search ..... 227/67; 226/67-68, 226/120-121, 127-128, 134, 165, 166; 198/730, 772, 859

[56] References Cited

U.S. PATENT DOCUMENTS 3,924,788 12/1975 Foruto ..... 227/67

*Primary Examiner*—E. R. Kazenske
*Assistant Examiner*—Douglas D. Watts
*Attorney, Agent, or Firm*—Blum, Kaplan, Friedman, Silberman & Beran

[57] ABSTRACT

This invention provides a tag attacher for use in driving tag pins into articles by an operation of a lever so as to affix price tags or the like thereto. Each tag pin consists of a head portion, a lateral rod, and a filament connecting the head portion and lateral rod together. A plurality of such tag pins are joined in an uprightly extended state to a connecting bar to form a comb-shaped tag pin assembly. The tag pin assembly is formed by integrally molding a synthetic resin, and adapted to be loaded as it is in the tag attacher. A tag attacher body has a connecting bar guide portion, and is provided with a cam plate in the vicinity of the guide portion. The cam plate is so designed that it is moved upwardly when the lever is drawn inwardly, then downwardly when the lever is released. The cam plate is provided with a stationary claw and a movable claw, which are adapted to support the connecting bar of a tag pin assembly loaded in the tag attacher body. The movable claw is adapted to slide on the surface of the connecting bar when the cam plate is moved upwardly, and feed the connecting bar when the cam plate is moved downwardly. The movable claw advances to a tag pin-shooting position in accordance with an operation of the lever.

3 Claims, 9 Drawing Figures

TAG ATTACHER

BACKGROUND OF THE INVENTION

1. Field of the Invention

This invention relates to a tag attacher for use in affixing price tags or the like to articles, or putting a plurality of articles together, with tag pins of a synthetic resin.

2. Description of the Prior Art

A tag pin consists of a head portion, a lateral rod, and a filament connecting the head portion and lateral rod together.

Such a tag pin is formed integrally with a molecule-orientable synthetic resin, such as nylon or polypropylene. The filament of the tag pin is in a stretched state, and formed thin and flexibly.

This tag pin of a synthetic resin, which permits affixing a price tag or the like to an article quickly, has recently been used in large quantities. Each tag pin has extremely small sizes. Therefore, the tag pins are usually manufactured as tag pin assemblies, each of which consists of several tens of tag pins joined to a connecting bar via their respective connecting portions. The tag pins in such a tag pin assembly are usually arranged at intervals of around 2 mm in order that a metal mold for the production thereof can be made conveniently, and in order that the tag pin assembly can be loaded in a tag attacher so as to drive the tag pins one by one into articles conveniently. Such a tag pin assembly is loaded in a tag attacher so as to be driven one by one into articles by a means, which will be described later. In a conventional tag attacher, the teeth of a gear are inserted among the tag pins joined to a connecting bar, and a lever provided on the tag attacher is operated so as to oscillate the gear tooth by tooth and thereby move the tag pins one by one.

A tag pin feed means provided in a conventional tag attacher employs a gear of a fixed pitch. Therefore, the distance between two adjacent tag pins joined in an uprightly extended state to a connecting bar as mentioned above is set to a level in agreement with the pitch of the gear. However, it has become necessary in recent years to reduce or increase the distance between two adjacent tag pins. In fact, when the distance between two adjacent tag pins joined to a connecting bar is reduced, the dimensions of a metal mold for forming tag pin assemblies can be reduced, and the thermal capacity thereof can thereby be reduced. This permits the heat to be used economically, and a metal mold to be manufactured at a lower cost. When the distance between two adjacent tag pins having very long filaments is increased, the filaments can be prevented from being intertwined with one another.

However, the pitch of a gear in a tag pin feed means in a conventional tag attacher is set to a fixed level as mentioned above. Accordingly, when the distance between the tag pins joined to a connecting bar is changed, it naturally disagrees with the pitch of the gear. Therefore, a tag pin assembly, in which the distance between two adjacent tag pins joined to a connecting bar is around 2 mm, can be loaded in a conventional tag attacher, and the tag pins thereof can be driven into articles. However, in a conventional tag attacher, it is impossible to feed such tag pins in a tag pin assembly that are arranged at intervals of greater or smaller than around 2 mm.

A conventional tag attacher has another problem. A conventional tag attacher is provided with a guide slit for loading a tag pin assembly therein. The width of the guide slit is considerably large as compared with the thickness of the connecting bar of a tag pin assembly. Moreover, the connecting bars of tag pin assemblies made by different manufacturers have different thicknesses. Accordingly, when a connecting bar is inserted into the guide slit, the former is moved laterally in the latter to such an extent that is in accordance with the width of the clearance occurring therebetween. Therefore, the connecting bars cannot be fed at a constant rate when a feed means, for example, a feed claw, is used, which is adapted to come into contact with, for example, a side surface of the connecting bar during a connecting bar-feeding operation.

SUMMARY OF THE INVENTION

It is, therefore, a general object of this invention to eliminate the drawbacks encountered in the above-described conventional tag attacher.

A primary object of this invention is to provide a tag attacher, which permits driving into an article a tag pin joined in an uprightly extended state to a connecting bar in a tag pin assembly loaded therein irrespective of the distance between two adjacent tag pins in the tag pin assembly and the kind of the tag pin assembly.

A second object of this invention is to provide a tag attacher, which permits feeding a tag pin assembly at a constant rate even when there is a large clearance between a guide slit for loading the tag pin assembly and a connecting bar therein to which tag pins are joined in an uprightly extended state.

A third object of this invention is to provide a tag attacher, which permits loading any kind of tag pin assemblies therein.

DESCRIPTION OF THE PREFERRED EMBODIMENTS

Figure 1:
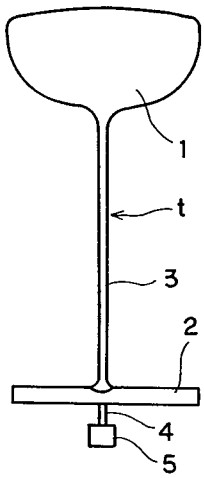
FIG. 1 is a front elevational view of an example of a tag pin assembly.
Figure 2:
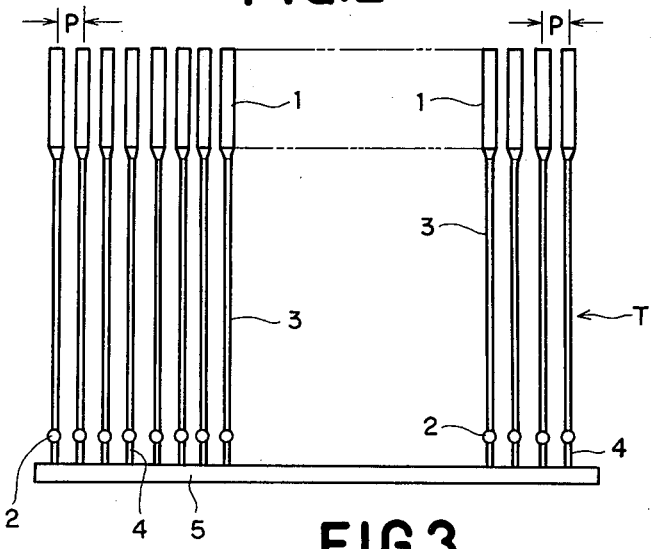
FIG. 2 is a side elevational view of the tag pin assembly shown in FIG. 1.

A tag pin t consists of, as shown in FIGS. 1 and 2, a head portion 1, a lateral rod 2, and a filament 3 connecting the head portion 1 and lateral rod 2 together. Several tens of tag pins t are joined to a connecting bar 5 via their respective connecting portions to form a tag pin assembly T. The tag pin assembly is obtained by integrally molding a synthetic resin.

Figure 3:
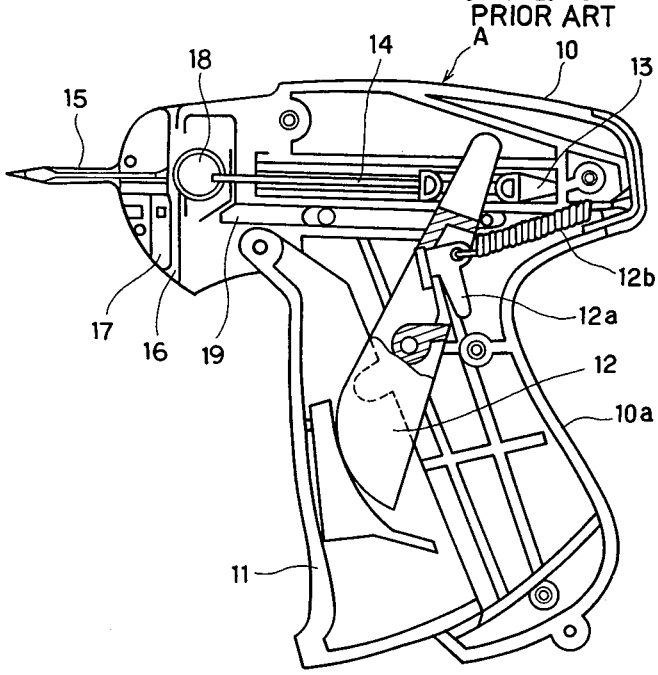
FIG.3 PRIOR ART
FIG. 3 is a side elevational view in section of a conventional tag attacher.

In a conventional tag attacher A shown in FIG. 3, a lever 11 is provided oscillatably at a grip portion 10*a* of a tag attacher body 10, and the movement of the lever 11 is transmitted to an intermediate lever 12 and a slider 13 to move a push rod 14 toward a side-slitted hollow needle 15, and thrust the lateral rod 2 of a tag pin t, which is positioned at the rear end of the hollow needle 15, into the same hollow needle 15. The lateral rod 2 is thus driven through the hollow needle, which is inserted through clothes, to the rear side thereof, so that a price tag or the like is affixed to the clothes with the tag pin. This tag attacher A is provided with a guide bore 16 at a front portion thereof. The tag pins are fed in the downward direction with the connecting bar inserted into the guide bore. When the lateral rod 2 of a tag pin t is passed through the hollow needle 15, the connecting portion 4 thereof is cut with a blade 17.

Figure 4:
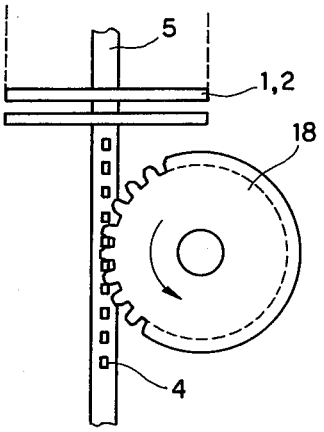
FIG.4 PRIOR ART
FIG. 4 is a front elevational view of a feed means for a conventional tag attacher.

A feed means for such a conventional tag attacher A consists of, as shown in FIG. 4, a gear 18, the teeth of which are fitted among the connecting portions 4 joined in an uprightly extended state to the upper surface of the connecting bar 5. When the lever 11 is gripped so as to be oscillated, a slide bar 19 is moved, so that a ratchet pawl is driven by a cam means (not shown) to oscillate the gear 18 tooth by tooth or intermittently and thereby feed the tag pins one by one.

The pitch p of the tag pins t on the connecting bar 5 is approximately 2 mm as previously mentioned. Accordingly, the pitch of the connecting portions 4 is also approximately 2 mm.

Thus, when the distance between two adjacent connecting portions 4 is not in agreement with the pitch p referred to above, trouble arises. Namely, since the teeth of the gear 18 in the conventional tag attacher are inserted among the connecting portions 4 of tag pins t as shown in FIG. 4, different types of tag pins having a larger or smaller pitch p of the connecting portions 4 thereof are not, of course, engageable with the gear 18.

The tag attacher according to the present invention has been obtained on the basis of the inventor's efforts directed to the eliminating of the drawbacks encountered in the above-mentioned prior art tag attacher. The characteristics of the tag attacher according to the present invention reside in the following. A cam plate adapted to be moved vertically in accordance with an operation of a lever is provided close to and on one side of a groove for guiding a connecting bar therein, and the cam plate is provided with a stationary claw and a movable claw thereon. The connecting bar 5 is held in a pressed state at both side surfaces thereof between the two claws, and fed in such a manner that the lowermost tag pin is stopped in a driving position close to an inlet of the side-slitted hollow needle.

Embodiments of the present invention will now be described.

Figure 5:
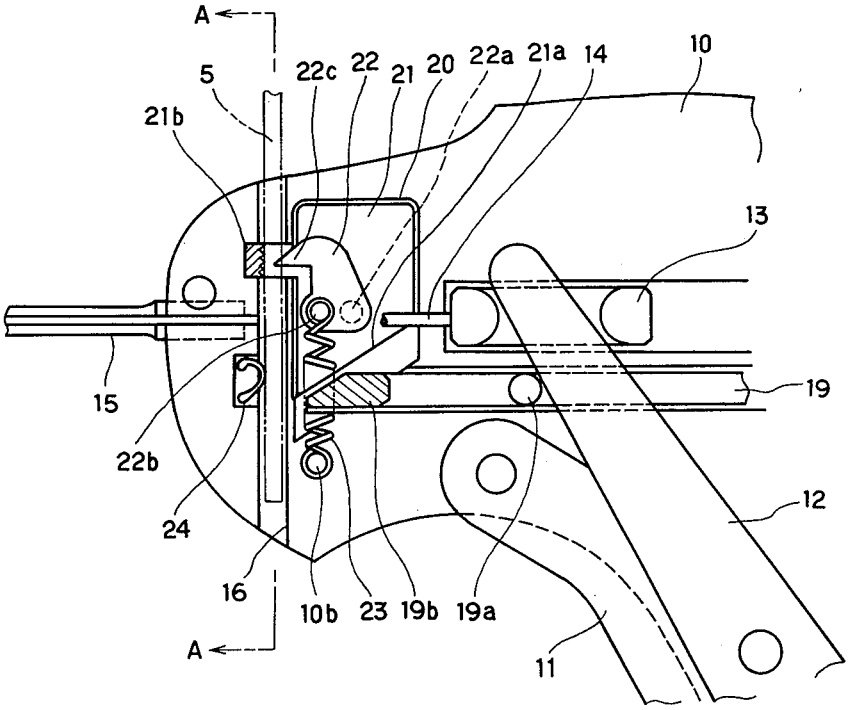
FIGS. 5 and 6 are front elevational views in section of a first embodiment of a tag attacher according to the present invention, illustrating the operational condition of a feed means therefor.

FIG. 5 is a front elevational view of a principal portion of the present invention. The present invention is characterized in that a feed means having stationary and movable claws is provided instead of the gear 18 shown in FIG. 3.

The tag attacher according to the present invention is provided with a guide groove 16 in a front portion of a tag attacher body 10, which guide groove 16 is adapted to hold a connecting bar of a tag pin assembly T. A recess 20 is provided on one side of the guide groove 16, and a cam plate 21 is held in the recess 20 in such a manner that the cam plate 21 can be moved therein slidingly in the vertical direction. The cam plate 21 has at the lower side thereof an inclined guide surface 21*a*, with which a contact portion 19*b* of a slide bar 19 is engaged. The slide bar 19 is provided with a projection 19*a*. When an intermediate lever 12 is oscillated forwardly to be inclined, it comes into contact with the projection 19*a*. As a result, the cam plate 21 is raised by the contact portion 19*b* formed at a front end of the slide bar 19.

The cam plate 21 is provided with a movable claw 22 pivotally supported thereon via a shaft 22*a*. A spring 23 is provided between a pin 22*b* fixed into the movable claw 22 and a pin 10*b* fixed into the tag attacher body 10. The cam plate 21 is also provided with a stationary claw 21*b* supporting one side surface of the connecting bar 5. The other side surface of the connecting bar 5 is supported on a free end portion 22*c* of the movable claw 22, to which moment of leftward rotation is applied. The free end portion 22*c* is so formed that the free end portion 22*c* comes into engagement with the connecting bar 5 when it is moved downwardly, and not when it is moved upwardly.

Figure 6:
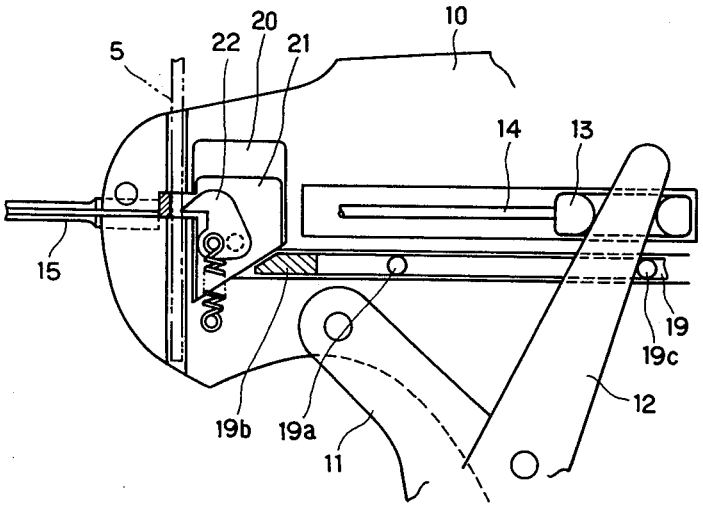

FIG. 5 shows a stage of an operation of an embodiment of the present invention, in which the lever 11 is gripped to cause one tag pin t in the tag pin assembly T to be driven into an article. In this stage of an operation of the tag attacher, the cam plate 21 is raised to the higher limit position. When the gripping force applied to the level 11 is then lessened, the lever 11 returns to the position shown in FIG. 6. While the lever 11 returns to the mentioned position, the intermediate lever 12 comes into contact with a projection 19*c* provided on the slide bar 19, to move the slide bar 19 to right. As a result, the contact portion 19*b* at the front end of the slide bar 19 is also moved in the same direction to allow the cam plate 21, which has been raised by and supported on the contact portion 19*b*, to be moved downwardly along the vertical edges of the recess 20 by the force of the spring 23.

Since both side surfaces of the connecting bar 5 of the tag pin assembly T are held firmly between the stationary claw 21*b* provided on the cam plate 21 and the free end portion 22*c* of the movable claw 22 pivotally connected thereto, a subsequent tag pin is moved by the force of the spring 23 to the tag pin-driving position after the preceding tag pin in the lowermost position has been driven into an article.

A surface (not shown in detail) for supporting the lateral rod 2 of a tag pin t is provided just under the surface along which the push rod 14 is moved. When the tag pin t is lowered after the preceding tag pin has been driven into an article, the lateral rod 2 of the lowermost tag pin is held on the support surface mentioned above, so that the axis of the push rod 14 and that of the lateral rod 2 are aligned with each other.

This tag attacher is also provided with a stopper 24, which permits the tag pin assembly T, which is loaded in the front portion of the tag attacher body, to be moved in only one direction (downward direction). Therefore, even when the cam plate 21 is moved upwardly from the position shown in FIG. 6 to the position shown in FIG. 5 the stationary claw 21*b* and the free end portion 22*c* of the movable claw 22 are merely slided on both surfaces of the connecting bar 5 of the tag pin assembly T, so that the connecting bar 5 is not moved upwardly.

Figure 9:
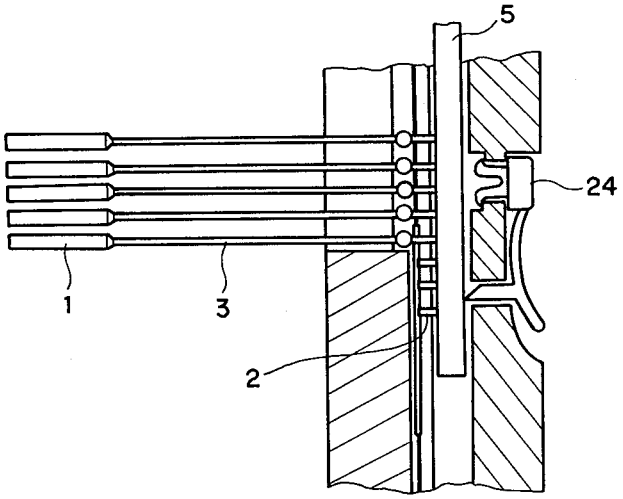
FIG. 9 is a sectional view taken along line A—A of FIG. 5.

The stopper 24 shown in FIG. 5 may otherwise comprise a configuration, for example, such as shown in FIG. 9.

Figure 7:
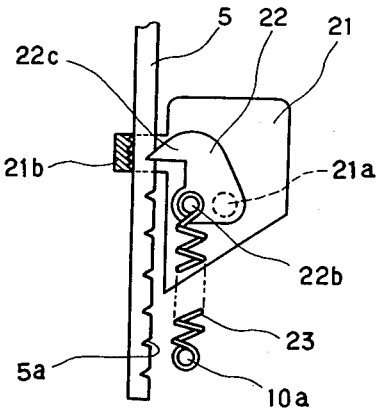
FIG. 7 is a front elevational view, illustrating a connecting bar being moved by a feed means, which is driven by a vertically-moving cam plate.

It is preferable that the tip of the free end portion 22*c* of the movable claw 22 be specially shaped as shown in FIG. 7, to allow the same to come into engagement with the surface of the connecting bar 5 when the claw 22 is downwardly moved. In such a case, small dents 5*a* are left in the surface of the connecting bar 5. When the dents are too large, it becomes difficult to withdraw the tag pin assembly from the tag attacher body during a tag pin-driving operations. Therefore, it is necessary to shape the tip of the movable claw with care.

Figure 8:
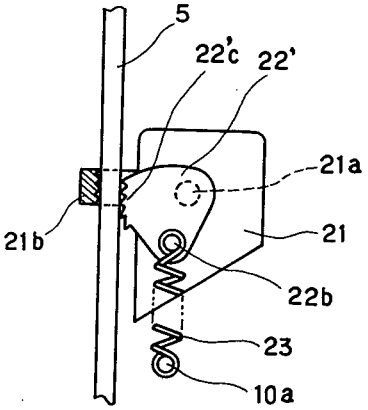
FIG. 8 is a front elevational view of a second embodiment of the present invention employing a movable claw, the shape of which is different from that of the movable claw employed in the first embodiment.

FIG. 8 shows a second embodiment of the present invention, in which a movable claw 22' is provided instead of the movable claw 22 in the first embodiment. This movable claw 22' is supported oscillatably on a cam plate 21 via a shaft 21*a*, and provided at a free end portion 22*c'* thereof with a plurality of small teeth similar to the teeth of a ratchet and arranged along an arcuate line. When the claw 22' is oscillated to left by the force of a spring 23, a connecting bar 5 is pressed against the stationary claw 21*b* by the free end portion 22*c'* to be held therebetween firmly.

According to the present invention described in detail above, a connecting bar 5 is held firmly at both side surfaces thereof between the stationary claw 21*b* and movable claw 22, 22', which are provided on the cam plate 21 adapted to moved upwardly by an operation of the lever 11 and downwardly by the force of the spring 23. Since the connecting bar 5 is drawn downwardly by the force of the spring 23, the tag pins can be fed to the tag pin-driving position irrespective of the pitch thereof.

Therefore, when the cam plate 21 in the tag attacher according to the present invention is formed to such special sizes that permit the cam plate 21 to be moved in the vertical direction intermittently by such a distance each time that is somewhat smaller than the pitch of the tag pins, tag pin assemblies having various pitches of tag pins can be loaded to drive the tag pins into articles.

Since the connecting bar 5 is held firmly at both side surfaces thereof between the stationary claw 21*b* and movable claw 22, the tag pin assembly can be fed at a constant rate even when a large clearance occurs between the surfaces of the guide groove 16 and connecting rod 2. Also, a tag pin assembly having a connecting bar of a different size (width) can be transferred intermittently and reliably.

As described previously, the tag attacher according to the present invention permits being applied freely to various types of tag pin assemblies, unlike a conventional tag attacher, in which only such type of a tag pin assembly that has tag pins of a specific pitch can be loaded. Thus, the tag attacher according to the present invention can be used very conveniently.

What is claimed is:

1. A tag attacher for dispensing tag pins from a tag pin assembly, said tag pin assembly being molded integrally in the shape of a comb from a synthetic resin, and said assembly including a plurality of tag pins joined at one end of each thereof to a connecting bar having side surfaces, each of said tag pins including a head portion, a lateral rod, and a filament connecting said head portion and said lateral rod together, comprising a tag attacher body having a connecting bar guide portion in which said connecting bar is guided, a side-slitted hollow needle supported on said body, a lever for forcing said lateral rods into said needle, a cam plate provided proximate said connecting bar guide portion of said tag attacher body, said cam plate being adapted to be moved upwardly when said lever is drawn inwardly, and downwardly when said lever is released, spring means for applying a resilient force to said cam plate to move said cam plate downwardly, and a stationary claw and a movable claw supported on said cam plate, said stationary claw and said movable claw being adapted to hold firmly therebetween both side surfaces of said connecting bar, said movable claw being adapted to slide on the surface of said connecting bar when said cam plate is upwardly moved, and feed said connecting bar when said cam plate is downwardly moved by said spring means.

2. A tag attacher according to claim 1, wherein said cam plate includes a lower side having an inclined guide surface, a slide bar engaged with said inclined guide surface, said slide bar being moved forwardly when said lever is drawn inwardly, to allow said cam plate to be moved upwardly, said slide bar being moved backwardly when said lever is released, to allow said cam plate to be moved downwardly.

3. A tag attacher according to claim 1, wherein said movable claw is pivotally supported on said cam plate, said spring means including a spring provided between said movable claw and said tag attacher body so as to be extended downwardly.

* * * * *